US008904685B2

(12) United States Patent
Pieracci

(10) Patent No.: US 8,904,685 B2
(45) Date of Patent: Dec. 9, 2014

(54) DIRECTIONAL SIGNAGE

(76) Inventor: Rhonda Pieracci, Valencia, CA (US)

( * ) Notice: Subject to any disclaimer, the term of this patent is extended or adjusted under 35 U.S.C. 154(b) by 0 days.

(21) Appl. No.: 13/135,362

(22) Filed: Jul. 1, 2011

(65) Prior Publication Data

US 2012/0000105 A1 Jan. 5, 2012

Related U.S. Application Data

(60) Provisional application No. 61/361,370, filed on Jul. 2, 2010.

(51) Int. Cl.

| | |
|---|---|
| ***G09F 13/26*** | (2006.01) |
| ***G09F 7/02*** | (2006.01) |
| ***G09F 1/02*** | (2006.01) |

(52) U.S. Cl.

CPC ... *G09F 7/02* (2013.01); *G09F 1/02* (2013.01)
USPC ..... 40/584; 40/633; 40/665; 116/63 R; 116/63 P; 24/16 PB

(58) Field of Classification Search

CPC ..... G09F 7/00; G09F 23/00; G09F 23/06; G09F 7/18; G09F 19/22
USPC ..... 40/584, 633, 665; 24/16 PB
See application file for complete search history.

(56) References Cited

U.S. PATENT DOCUMENTS

| | | | | |
|---|---|---|---|---|
| 2,373,778 | A * | 4/1945 | Quinby | 40/605 |
| 4,176,484 | A * | 12/1979 | Terris | 40/584 |
| 7,240,446 | B2 * | 7/2007 | Bekker | 40/633 |
| 2008/0301981 | A1 * | 12/2008 | Giro Amigo | 40/299.01 |

* cited by examiner

*Primary Examiner* — Syed A Islam
(74) *Attorney, Agent, or Firm* — Brooks Kushman P.C.; Roland J. Tong

(57) ABSTRACT

A signboard comprising a base; a plurality of signs formed on the base, the plurality of the signs comprising predefined shapes; and a perforation outline surrounding each of the plurality of the signs, the perforation outline adapted to allow for the removal of the plurality of the signs from the base.

19 Claims, 5 Drawing Sheets

DIRECTIONAL SIGNAGE

CROSS REFERENCE TO RELATED APPLICATIONS

This application claims the benefit of U.S. provisional patent application Ser. No. 61/361,370 filed Jul. 2, 2010.

STATEMENT REGARDING FEDERALLY SPONSORED OR DEVELOPMENT

None

TECHNICAL FIELD

The present application generally relates to signboards and, in one specific example, signboards that comprise at least one directionally shaped sign that can be easily removed or knocked-out along a perforated outline from a base.

BACKGROUND

Hardware stores, office supply stores, and the like, typically offer customers signage that provides an observer with text or directional information or symbols, such as an arrow shaped symbol, guiding one towards a particular location, event, or destination. For example, the Hillman Sign Center of Cincinnati, Ohio, offers a directional sign with text, such as "garage sale" and the arrow shaped symbol printed on a sign's surface. The directional sign has a perimeter shape of a rectangle and not that of the directional shape of an arrow. Consequently, even from a front facing side, the arrow's direction is less discernable from certain distances and less effective than, say, a particular directional sign with a discernable arrow-shaped perimeter.

Office Depot, Inc. and its retail outlets also offer a rectangular shaped sign with a directional arrow symbol printed on the sign's surface as part of a sign kit package. This sign kit package includes four individual signs made of plastic, measuring 11 inch by 14 inch. Similar to Hillman Sign Center's art above, each sign has a perimeter that is shaped as a rectangle. The sign kit package comes with two signs that have pre-printed arrow symbols pointed to the right and the remaining two signs with the arrow symbols pointed to the left. The shaped sign(s) come with indicia, such as "garage sale." Similar to the sign provided by the Hillman Sign Center, the perimeter of the sign is of a rectangular shape. The preprinted directional arrow is only printed on one side of the sign with the text. Because of the rectangular perimeter of the Office Depot signs, the visibility of the direction being conveyed and the variety of uses of the signs may be limited.

U.S. Pat. No. 4,176,485 describes a directional sign for providing observers with directional information to a particular location. A generally rectangular shaped sign has an arrow indicator secured to the rear of the sign. The arrow indicator can be concealed for packaging or storage purposes and can also be pivoted and extended from behind the rectangular shape in one of the three (right, left, and up) preset directions desired, thus allowing some flexibility. However, this directional sign may relatively be expensive and may only provide the person with a single sign to use. The sign may further require assembly, additional parts, and tools, to setup for display. Further, the design in the '485 patent creates an unconventional navigation shape, which is an arrowhead protruding from a rectangle. The directional message conveyed by this design may not be as clear as the directional message conveyed by a simple traditional arrow symbol.

With the foregoing in mind, it is an object of the present invention to satisfy the need for a relatively simple, efficiently packaged, or inexpensive directional sign which may be used by a person, such as a homeowner or an individual conducting an event, to convey directional information to an observer to travel along a pathway or to locate an event. It is another object of the invention to provide the directional sign with a much discernable directional perimeter shape.

BRIEF SUMMARY

The present invention includes a signboard comprising a base; a plurality of signs formed on the base, the plurality of the signs comprising predefined shapes; and a perforation outline surrounding each of the plurality of the signs, the perforation outline adapted to allow for the removal of the plurality of the signs from the base.

The present invention also includes a signboard comprising a first message means for conveying a direction; a second message means for conveying a direction; a support means for supporting the first and the second message means; a perforation means for allowing the first and the second message means to be removed from the support means, the perforation means surrounding the periphery of the first and the second message means, wherein the first and the second message means may be detached from the support means and used to provide a direction to a viewer.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

BRIEF DESCRIPTION OF THE SEVERAL VIEWS OF THE DRAWINGS

FIG. 10 is a front view of an embodiment wherein the perforations 112 form an outline for allowing the person to knock-out an arrow shaped directional sign 106 that can be manufactured in variety of connection strengths, including a variety of properties such as tensile strengths, material strengths, size and depth of dash cuts or spaces, and the like.

DETAILED DESCRIPTION

Figure 1:
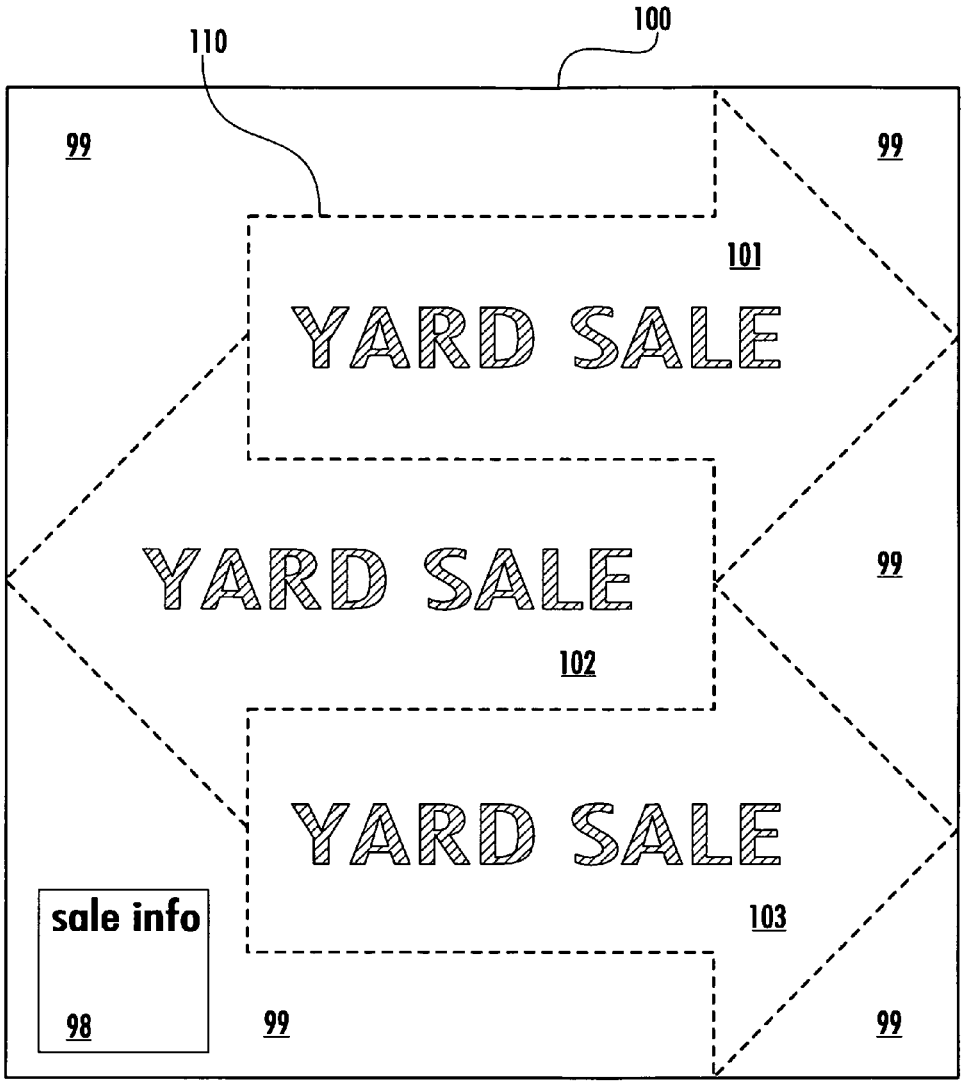
FIG. 1 is a front view depicting an embodiment wherein a plurality of directional signs that can be positioned utilizing an interlocking manner to maximize utilization of the base wherein each of the directionally shaped sign can be removed or knocked-out.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Disclosed is an improved directional sign for directing an observer to a destination, along a pathway or to an event. For instance, the destination, pathway or event could be a garage sale, yard sale, auction, open house, birthday party, family celebration, work project (i.e. film location, new construction project, car wash), a race or marathon route, parade, parking, or some business with a product or service to sell. In a more specific embodiment, there is disclosed a directional sign for directing an observer to a location with a directionally shaped perimeter, such as an arrow shape, wherein the directional shape can easily be removed or knocked-out along a perforated outline from a base, such as a rectangular poster board. The removed directional shape may include a preprinted message or indicia or may be blank to allow for a user-generated indicia, or some combination of the like. The indicia on the face of the sign surface may include such items as a description of the destination's address, a direction to a destination, a pathway, or a name of an event or a product.

In certain embodiments, there is illustrated a signboard comprising a base that contains a plurality of directional shapes, wherein the directional shapes may include perforated outlines. The directional shapes can each be removed from the base along the perforated outlines. It can be appreciated that the directional shapes may be more effective in directing a viewer than rectangular or square shaped signs, as they may be more discernable than rectangular or square shaped signs.

In another embodiment, there is disclosed a signboard that includes a plurality of directional shapes constructed of inexpensive materials suitable for temporary signage, such as a poster board. The plurality of directional shapes within the signboard may be separated by perforation outlines with a variety of connection strengths. The connection strengths may be dependent on materials and fabrication methods utilized. The fabrication methods may utilize a series and a variety of cuts. The connection strengths may employ re-attaching a cut section. Certain sections along the perforated outline may be re-attached with a material providing temporary adhesive. Certain sections along the perforated outline may be re-attached with a material providing temporary compression. In yet another embodiment, there is disclosed a base that contains a plurality of interlocking directional shapes, wherein the interlocking directional shapes have a perforated outline. The interlocking directional shapes can each be removed from the base along the perforated outline and may provide a person a plurality of directional shapes that are each discernable when displayed.

Perforation herein refers to a manufacturing process of creating a delineation between at least two separate items or shapes along a dividing line or a shape's outline wherein the manufacturing process typically employs machine cuts made into the base along the shape's outline that allow the pre-designed directional shape to be more easily removed when pressure is applied by the person, such a customer, a product purchaser, homeowner, or a participant of an event. These cuts are typically spaced apart by gaps or spaces where no cuts are generated along the outline, thus allowing the pre-designed directional shape to be temporarily held or contained within the base until removed by pressure.

The base can be constructed in a variety of relatively inexpensive materials, such as poster board, cardboard, card stock, paper, plastic, foam core, Styrofoam, and the like. However, it should be appreciated by those skilled in the art that depending on the directional sign's purpose and where appropriate for the embodiments employed therein, the base could also be constructed of relatively more expensive materials such as fabric, vinyl, glass, Mylar, metal, wood, and the like. One benefit of utilizing a relatively inexpensive material for the base, such as poster board, is that it allows a retailer to offer the customer an inexpensive directional sign that is not simply a pre-printed arrow symbol on the rectangular shaped perimeter, but instead a directional shaped sign that has a discernable perimeter shape of, say, an arrow shape.

Further, the directional shaped sign may be relatively quick and easy to deploy than, say, a product that requires the person to use additional parts, assembly, or tools. For example, scissors may not be required to physically cut out the arrow shape from the base. The directional shaped sign may be attached to a number of elements, such as sign post, telephone pole, fence, a building, and the like.

Now turning to the figures, FIG. 1 is a front view depicting an embodiment wherein a plurality of directional signs are positioned on the base in an interlocking manner to maximize utilization of the base wherein each of the directionally shaped sign can be removed or knocked-out. The base 100 may be a flat sheet and may have a rectangular perimeter shape when initially packaged. The initial rectangular perimeter shape may be beneficial in certain situations, such as when displaying the product for retail sale. The base 100 may be constructed of the poster board material. A plurality of individual directional shaped signs, such as the arrow shapes may be positioned in the interlocking manner as depicted in FIG. 1. The plurality of individual directional shaped signs may be in a form of an interlocking arrow 101, an interlocking arrow 102, and an interlocking arrow 103. These interlocking arrows (101, 102, and 103) may have a perforation outline 110 that is preferably die-cut in advance during manufacturing. A user may easily remove or knock-out each interlocking arrow from the base 100 along the perforation outline 110 by applying pressure and leaving the break-away material 99. Individual directional shaped signs that each comprise the arrow-shaped perimeter are consequently created.

Interlocking arrows (101, 102, and 103) may also have a pre-printed outline near or along perforation outline 110, thus representing each interlocking arrow shape's perimeter. This pre-printed outline can be added to improve a viewer's ability to visualize the arrow shaped perimeter. This package of interlocking arrows created from the base may also include packaging information 98 printed on at least one surface. Packaging information 98 may allow for the product and the package to be self-contained in a single unit thereby reducing wasted materials and retail space. Packaging information 98 may include a bar code, price, instructions, company address, brand name, examples of use, and the like. Examples of use may be in a form of examples of certain indicia to place or write on the signs.

Figure 2:
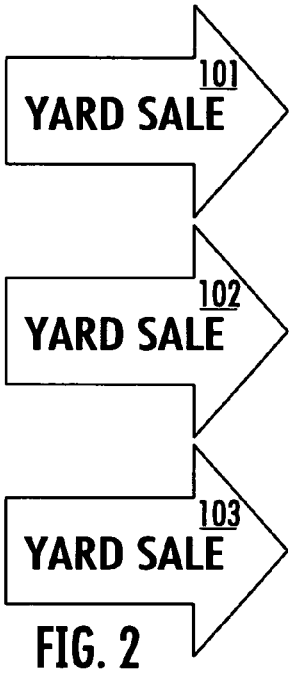
FIG. 2 is a front view depicting an embodiment wherein all three directional arrow signs from FIG. 1, employ the arrows pointing to the right.
Figure 3:
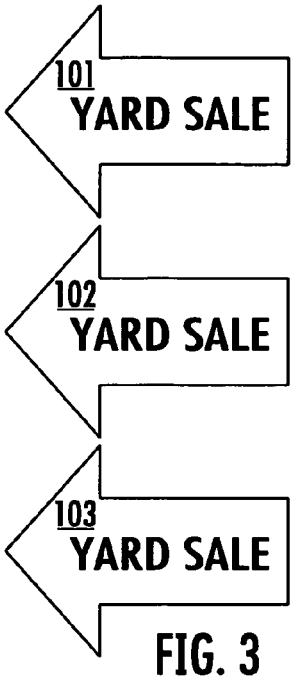
FIG. 3 is a front view depicting an embodiment wherein all three directional arrow signs from FIG. 1, employ the arrows pointing to the left.
Figure 4:
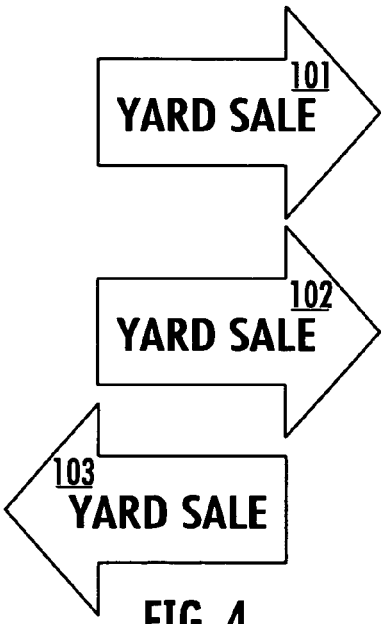
FIG. 4 is a front view depicting an embodiment wherein two directional arrow signs from FIG. 1, employ arrows pointing to the right and one arrow pointing to the left.
Figure 5:
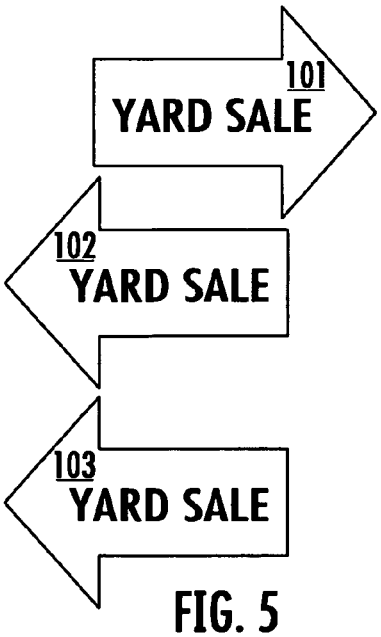
FIG. 5 is a front view depicting an embodiment wherein two directional arrow signs from FIG. 1, employ arrows pointing to the left and one arrow pointing to the right.

This package of interlocking arrows (101, 102, and 103) may also have pre-printed elements on each sign, such as with the indicia "Yard Sale." The interlocking arrows may also come blank and may allow the person to incorporate his/her own indicia, or the interlocking arrows may include some indicia and some room for the person to write an indicia thereon. The interlocking arrows can further come pre-printed with indicia on both sides of the directional arrow sign. As an example, a single retail package may include three arrows with the phrase "Yard Sale" printed on both sides. A single retail package may come as having either (1) all three directional arrow signs employ the arrows pointing to the right as depicted in the front view of FIG. 2, (2) all three directional arrow signs employ the arrows pointing to the left as depicted in the front view of FIG. 3 (which is the back side of FIG. 2), (3) two directional arrow signs employ arrows pointing to the right and one arrow pointing to the left as depicted in the front view of FIG. 4, or (4) two directional arrow signs employ arrows pointing to the left and one arrow pointing to the right as depicted in the front view of FIG. 5.

Figure 6:
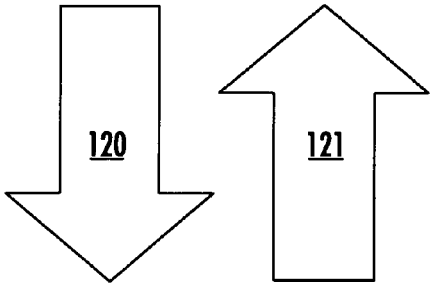
FIG. 6 is a front view depicting an embodiment wherein the directional arrow signs from FIG. 1, could also be employed pointing upward 120 or downward 121.

A single retail package may also incorporate an upward pointing arrow 120 as depicted in the front view of FIG. 6 and a downward pointing arrow 121, thus creating a larger multitude of display options to the user from a single and relatively inexpensive self-contained set of three interlocking directional arrows. It can be realized that certain embodiments of the present invention provide the ability to offer a package of directional signs that can be preprinted on both sides, inexpensive directional signs, signs with a discernable arrow shaped perimeter, and a wide range of directional options from a single package.

Certain embodiments provide two-sided signs can be deployed, mounted, or displayed in such a manner where the directional shape can be visibly exposed and utilized from both sides. Certain embodiments further provide interlocking directional shapes that may contain two arrows or more than three arrows, and that may be arranged in a variety of interlocking patterns or that may be fabricated to come in a variety of other interlocking shapes other than arrows (not shown).

Figure 7:
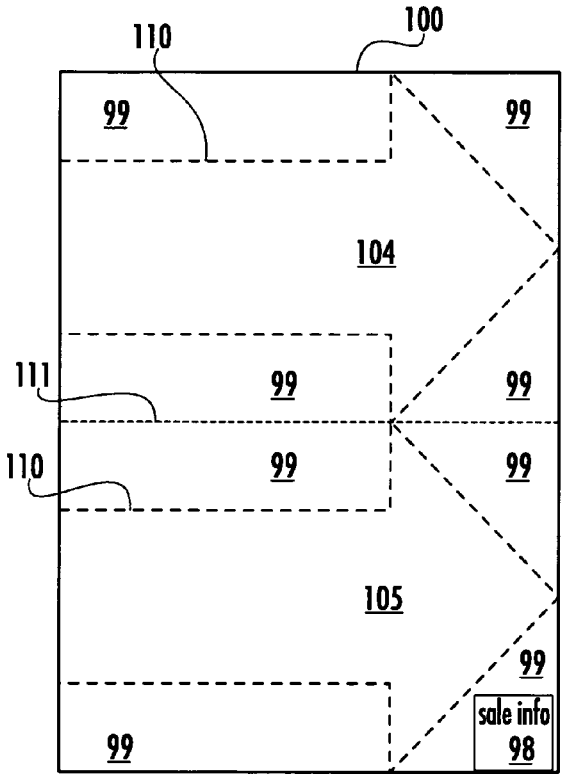
FIG. 7 is a front view depicting an embodiment wherein the flat sheet 100 includes two individual directional shaped signs that are arranged and packaged in such a manner that allows for conserving space, say for transport or while on display at retail, by folding the base 100 along a dotted line 111.

FIG. 7 is a front view depicting an embodiment wherein the base 100 includes two individual directional shaped signs that are preferably arranged and packaged in such a manner that conserves space, say, for transport or while on display at retail, by folding the flat sheet 100 along a dotted line 111. In this embodiment, two individual directional shaped signs (104 and 105) that are not necessarily interlocking in the base, have the arrow shaped perimeters. The signs 104 and 105 may be removed or knocked-out from the base 100 along a pre-fabricated perforation 110 similar to that explained in FIG. 1, leaving the break-away material 99.

The directional shaped sign(s) can be packaged with the pre-printed indicia message similar to FIG. 1 or appear blank as depicted in FIG. 7. It can be realized that the embodiment shown in FIG. 7 may offer directional shaped sign(s) that are contained inside of a protective outer shape, such as the rectangular shape depicted in FIG. 7, and that may produce discernable directionally shaped perimeter, such as the arrow shape, once knocked-out of the base 100.

Figure 8:
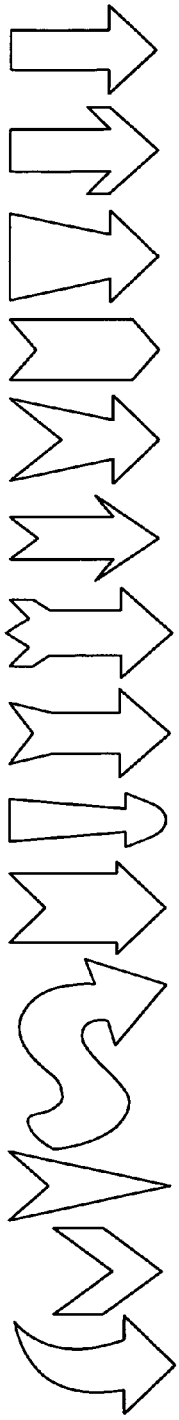
FIG. 8 is a depiction of a variety of just some of the embodiments the arrow shaped directional sign could encompass.

FIG. 8 is a depiction of a variety of just some of the embodiments the arrow shaped directional sign could encompass. In addition, other navigational shapes, letters, or numbers could also be packaged independently or as part of the base.

Figure 9:
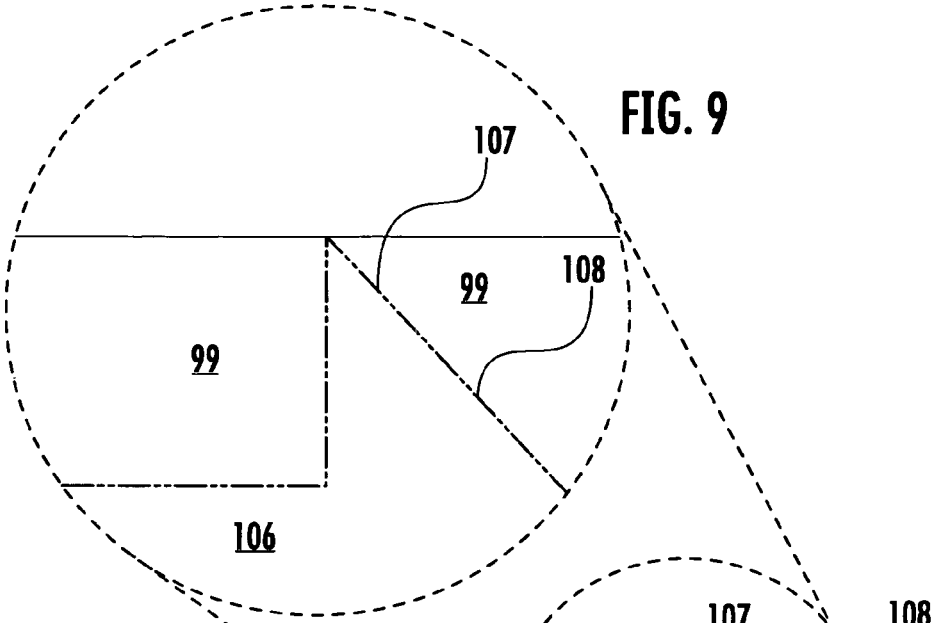
FIG. 9 is an enlarged detailed frontal view from FIG. 10 of a method of employing a variety of perforation 112 connection strengths.
Figure 10:
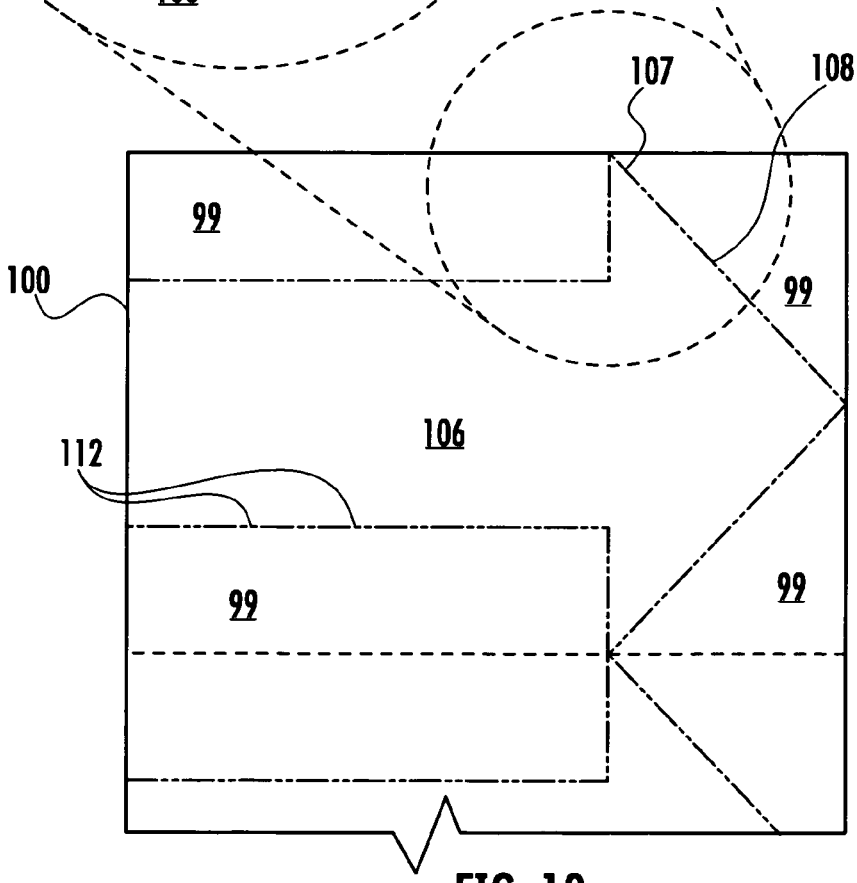

FIG. 9 is an enlarged detailed frontal view from FIG. 10 of a method of employing a variety of perforation connection strengths. The perforations 112 that form the outline for allowing the person to knock-out a particular arrow shaped directional sign 106 depicted in FIG. 10, can be manufactured by employing a variety of connection strengths methods and materials, including a variety of properties such as tensile strengths, material strengths, but is typically done with a plurality of cuts or a variety cut sizes (e.g. length, width, and depth) made into the base. The connection strength between the base and a connected shape contained inside or along side the base, such as the directional shaped sign, may be dependent on the cut sizes or the frequency of the cuts (e.g. die-cuts, tooth cuts, and dash-cuts) made during the fabrication, the size and frequency of the gaps or spaces (uncut spaces between cuts), and the like. To illustrate, a particular perforation portion 107 could vary in fabrication, construction or structure from another perforation portion 108, wherein perforation portion 108 may include perforated cuts that are measurably deeper, wider, or longer through the flat sheet 100 compared to perforation 107. Perforation portion 107 includes cuts that occur more frequently in density or frequency number along the perforation outline 112. Perforation portion 107 includes uncut spaces or gaps that are measurably much shallow, much narrower or shorter in linear distance when relatively compared to perforation portion 108. Connection strengths may be varied selectively, such as at certain corners or along any change in direction, or in particular, a sharp change in direction (e.g. wherein a definable angle vector threshold is determined and applied). For instance, the connection strength may be stronger in areas where the outline perforation 112 is straight or linear (e.g. wherein, not to exceed a definable curve or angle vector threshold defined and assigned) than the connection strength in the portion of the perforation 112 that is curved or angled.

In another embodiment, the portion 107 could be completely cut from the base and only the portion 108 is still attached by the outline perforation 112 or vice-versa. In yet another embodiment, the outline perforation 112 could employ a plurality of portions beyond the two described, wherein some are completely cut, or some exist in varying types of cuts as, described. For instance, there could be a number of uniquely defined portions each with unique fabrication conditions.

In another embodiment, the arrow shaped directional sign 106 may have been completely cut from the base and is "re-attached" along the arrow shaped directional sign only at each of the portions 108 of the outline. Depending on the materials of the base, the arrow shaped directional sign 106 may have been re-attached with a variety of temporary adhesive materials, such as epoxy, glue, wax, welds and the like. The arrow shaped directional sign 106 may have been re-attached by adding materials that create compression, such as foam, chalk, putty, and the like (not shown). The arrow shaped directional sign 106 may be made from metal and re-attached with a light-breakable weld back inside a base of the same metal or some other appropriate material. It may be made of wood and reattached with a breakaway putty back inside a base of the same wood or some other appropriate material. It may also be made from plexiglass and re-attached with a removable epoxy back inside a base of the same plexiglass or some other appropriate material.

This varying connection strength can help protect the arrow shaped directional sign 106 from being removed prematurely from the base, for instance, before a retail purchase. The varying connection strengths can also help prevent any potential damage due to difficulties the person might encounter trying to remove a particular angular shaped component of a particular directional sign, such as a point or fins of an arrowhead that are too firmly connected base.

Figure 11:
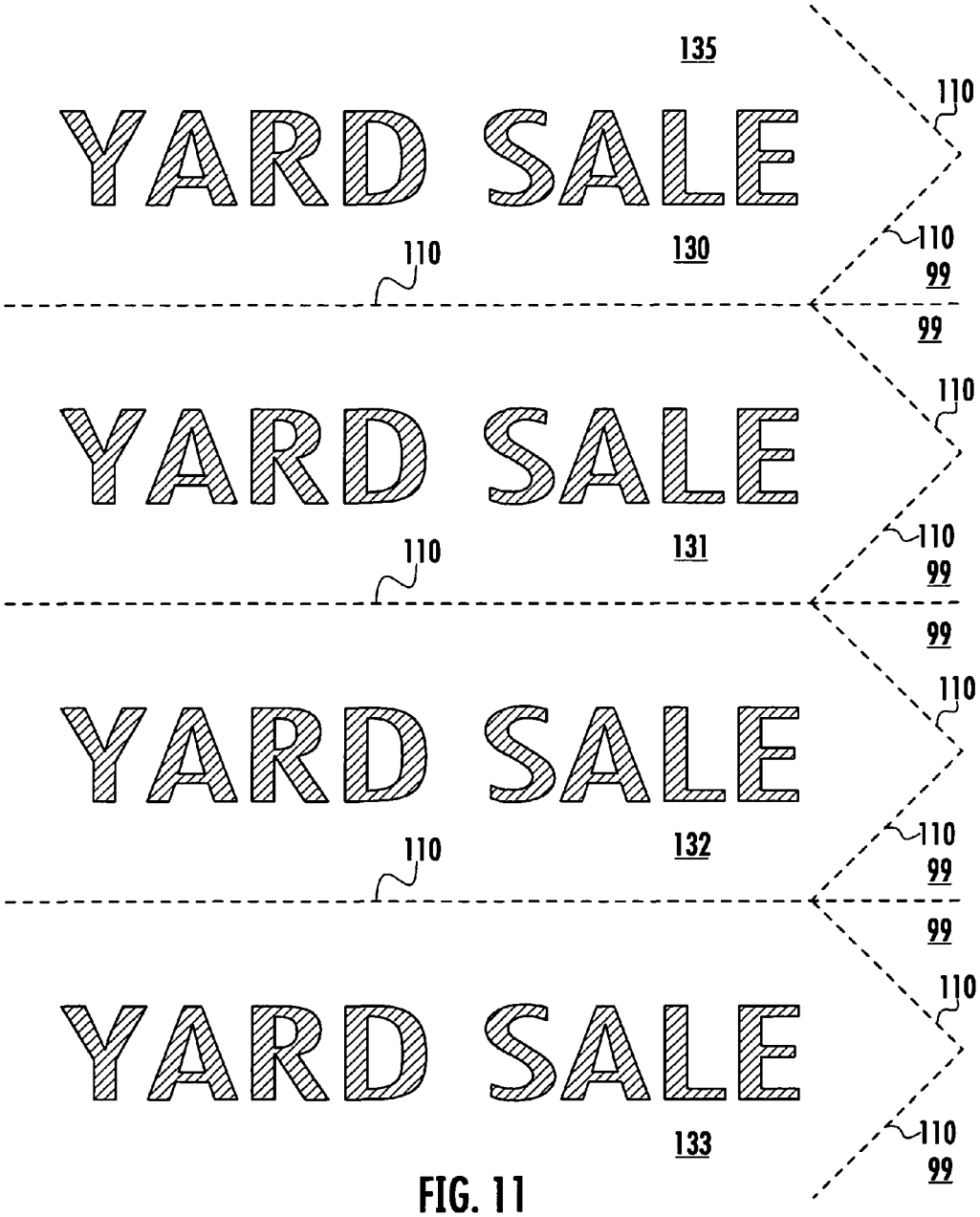
FIG. 11 is a front view of another embodiment of the present invention.

With reference now to FIG. 11, another embodiment of the present invention may include a signboard that includes a plurality of directionally shaped signs 130, 131, 132, and 133 preferably positioned parallel to each other and preferably pre-cut. The perimeter of the signs 130, 131, 132, and 133 are preferably surrounded by perforation outlines 110. In one embodiment, the perforation outlines 110 may be include an end shaped like an arrowhead. A user may fold the base 135 at the perforation outlines 110 and tear the signs 130, 131, 132, and 133 for use. When the directionally shaped signs 130, 131, 132, and 133 are removed from the base 135, the base 135 may be left with break-away materials 99. It can be appreciated that the embodiment in FIG. 5 results in very minimal waste of base material.

The directional shaped signs can be produced in a variety of shapes, sizes, colors (including fluorescent colors), weights, materials, and surfaces with a variety of directional shapes, ornamental shapes, and a variety of indicia (including printing on one surface or side, on both surfaces or sides, or on neither surface or side) for deploying with a variety of purposes. The indicia could include or allow for a combination of hand-drawn, handwritten or printed indicia, including text, symbols, logos, maps, graphics, artwork, compass and navigation symbols, directional shapes, and the like.

It can now be realized that certain embodiments of the present invention provide a convenient way of packaging multiple signs into one handy board. Users may not need to purchase and carry multiple bulky signs. They can purchase a single board, and they can easily detach, generate, and use multiple signs out of the board.

Although the description above contains many specifications, these should not be construed as limiting the scope of the invention but as merely providing illustrations of some of the presently preferred embodiments of this invention. For example, the order in which the steps are presented above is not limited to any particular order and does not necessarily imply that they have to be performed in the order presented. The invention is not limited in its application to the details of the construction and to the arrangement of the components set forth in the above description or as illustrated in the drawings.

The invention claimed is:

1. A signboard comprising:

a. a base;

b. a plurality of signs formed on the base, the plurality of the signs including a first arrow and a second arrow, each of the first arrow and the second arrow including an arrowhead and a tail connected to the arrowhead, the tail including a first end adjacent to the arrowhead and a second end opposite the first end, a portion of the arrowhead of the first arrow extending next to the second end of the tail of the second arrow; and c. a perforation outline surrounding each of the plurality of the signs, the perforation outline adapted to allow for the removal of the plurality of the signs from the base.

2. The signboard of claim 1, further comprising a pre-printed indicia affixed on each of the plurality of the signs, the pre-printed indicia adapted to convey a message to a viewer.

3. The signboard of claim 1, wherein at least one of the plurality of the signs comprises an arrow.

4. The signboard of claim 3, wherein the arrow comprises a left-handed pointing orientation.

5. The signboard of claim 3, wherein the arrow comprises a right-handed pointing orientation.

6. The signboard of claim 3, wherein the arrow comprises an upward pointing orientation.

7. The signboard of claim 1, wherein the base is two-sided and the plurality of the signs appear on both sides of the base.

8. A signboard comprising:

a. a first message means for conveying a direction, the first message means including an arrowhead and a tail;

b. a second message means for conveying a direction, the second message means including an arrowhead and a tail, a portion of the arrowhead of the first message means abutting a portion of the tail of the second message means;

c. a support means for supporting the first and the second message means;

d. a perforation means for allowing the first and the second message means to be removed from the support means, the perforation means surrounding the periphery of the first and the second message means, wherein the first and the second message means are adapted to be detached from the support means and used to provide a direction to a viewer.

9. The signboard of claim 8, further comprising an indicia pre-printed on the first message means, the indicia conveying a message for the viewer.

10. The signboard of claim 8, wherein the first message means is on one side of the support means and the second message means is on an opposing side of the support means.

11. The signboard of claim 8, wherein the first message means comprises an arrow.

12. The signboard of claim 8, wherein the support means comprises a poster board.

13. The signboard of claim 8, wherein the first message means comprises an arrow pointing to a left-hand orientation and the second message means comprises an arrow pointing to a right-hand orientation.

14. The signboard of claim 8, wherein the first message means comprises an arrow pointing up and the second message means comprises an arrow pointing down.

15. A signboard comprising:

a. a base defining a plurality of directionally shaped signs, the plurality of directionally shaped signs including a first arrowhead and a first tail attached to the first arrowhead and a second arrowhead and a second tail attached to the second arrowhead, a portion of the first arrowhead being extending over a portion of the second tail; and b. a perforation separation each of the plurality of directionally shaped signs, the perforation surrounding the periphery of each of the plurality of the directionally shaped signs to allow each of the plurality of the directionally shaped signs to be removed from the base.

16. The signboard of claim 15, further comprising a first indicia disposed on at least one of the plurality of the directionally shaped signs, the indicia adapted to convey a message to a viewer.

17. The signboard of claim 15, wherein the plurality of directionally shaped signs are positioned to oppose each other.

18. The signboard of claim 15, wherein at least one of the plurality of directionally shaped signs comprises an arrow.

19. The signboard of claim 16, further comprising a second indicia disposed opposite the first indicia.

* * * * *